US012127588B2

(12) United States Patent
Doyle

(10) Patent No.: US 12,127,588 B2
(45) Date of Patent: Oct. 29, 2024

(54) AEROSOL-GENERATING DEVICE HAVING HOLDING MECHANISM

(71) Applicant: Philip Morris Products S.A., Neuchatel (CH)

(72) Inventor: Michael Elliott Doyle, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/455,404

(22) Filed: Aug. 24, 2023

(65) Prior Publication Data

US 2023/0397663 A1 Dec. 14, 2023

Related U.S. Application Data

(63) Continuation of application No. 16/754,208, filed as application No. PCT/EP2018/079206 on Oct. 24, 2018, now Pat. No. 11,819,057.

(30) Foreign Application Priority Data

Oct. 24, 2017 (EP) ..... 17198144

(51) Int. Cl.
*A24F 40/40* (2020.01)
*A24F 40/485* (2020.01)
(Continued)

(52) U.S. Cl.
CPC ..... *A24F 40/40* (2020.01); *A24F 40/485* (2020.01); *A24F 40/20* (2020.01); *A24F 40/50* (2020.01)

(58) Field of Classification Search
USPC ..... 131/329
See application file for complete search history.

(56) References Cited

U.S. PATENT DOCUMENTS 4,466,448 A 8/1984 Aikman
5,706,832 A 1/1998 Gold
(Continued)

FOREIGN PATENT DOCUMENTS

CA 2 975 654 A1 8/2016
CN 201602128 U 10/2010
(Continued)

OTHER PUBLICATIONS

Korean Office Action issued Aug. 4, 2023 in Korean Patent Application No. 10-2020-7010756 (with English Translation), 14 pages.
(Continued)

*Primary Examiner* — Harshad C Patel
(74) *Attorney, Agent, or Firm* — Oblon, McClelland, Maier & Neustadt, L.L.P.

(57) ABSTRACT

An aerosol-generating device for heating an aerosol-generating article is provided, the device including: a housing having an opening; a chamber within the housing to receive at least a portion of the article through the opening; a heater assembly within the housing and including a heating element to heat at least a portion of the chamber; a mechanism including at least one member at or proximate to the opening and configured to move between a first position in which the article can be inserted into the chamber via the opening, and a second position in which the member has reduced a size of the opening relative to a size of the opening when the member is in the first position; and at least one guide track along which the member is configured to slide when the member moves between the first and the second positions.

20 Claims, 6 Drawing Sheets

(51) Int. Cl.
*A24F 40/20* (2020.01)
*A24F 40/50* (2020.01)

(56) References Cited

U.S. PATENT DOCUMENTS

| | | | | |
|---|---|---|---|---|
| 5,730,181 | A * | 3/1998 | Doyle | G05D 7/0635 137/487.5 |
| 5,923,529 | A * | 7/1999 | Mimachi | G06F 13/409 361/785 |
| 6,688,313 | B2 | 2/2004 | Wrenn et al. | |
| 6,884,120 | B1 * | 4/2005 | Haba | H01R 12/88 439/630 |
| 7,699,624 | B2 * | 4/2010 | Muramatsu | G01D 11/28 439/541.5 |
| 8,591,265 | B2 * | 11/2013 | Huang | H01R 13/6597 439/660 |
| 8,864,420 | B2 * | 10/2014 | Foo | E02B 17/021 414/137.1 |
| 8,864,520 | B2 * | 10/2014 | Lan | H01R 12/714 439/607.14 |
| 9,054,440 | B2 * | 6/2015 | Taylor | H01R 27/02 |
| 9,054,550 | B2 * | 6/2015 | Akai | B60L 3/0069 |
| 9,220,304 | B2 * | 12/2015 | Greim | A24F 40/85 |
| 10,193,211 | B2 * | 1/2019 | Finn | H01Q 7/005 |
| 10,777,877 | B2 * | 9/2020 | Su | H01Q 1/2291 |
| 11,114,785 | B2 * | 9/2021 | Hung | H05K 1/111 |
| 11,133,612 | B2 * | 9/2021 | Hung | H01R 13/648 |
| 2007/0235047 | A1 | 10/2007 | Long | |
| 2011/0253154 | A1 | 10/2011 | Dolciato | |
| 2014/0348495 | A1 * | 11/2014 | Greim | A24F 40/85 392/386 |
| 2015/0114409 | A1 * | 4/2015 | Brammer | A61M 15/025 |
| 2017/0099877 | A1 * | 4/2017 | Worm | A61M 11/042 |
| 2017/0303598 | A1 * | 10/2017 | Li | A24F 40/46 |
| 2018/0338541 | A1 | 11/2018 | Worm et al. | |
| 2019/0114526 | A1 * | 4/2019 | Finn | H01Q 21/29 |
| 2019/0281598 | A1 * | 9/2019 | Almalfouh | H04W 28/18 |

FOREIGN PATENT DOCUMENTS

| | | | | |
|---|---|---|---|---|
| CN | 103987286 | A | 8/2014 | |
| CN | 104023568 | A | 9/2014 | |
| CN | 204056645 | U | 12/2014 | |
| CN | 104770878 | A | 7/2015 | |
| CN | 205005900 | U | 2/2016 | |
| CN | 103997922 | B | 12/2016 | |
| CN | 206213269 | U | 6/2017 | |
| CN | 107105766 | A | 8/2017 | |
| CN | 107105767 | A | 8/2017 | |
| EP | 3228199 | A2 * | 10/2017 | A24F 40/46 |
| GB | 2 51 1 306 | A | 9/2014 | |
| GB | 2 534 215 | A | 7/2016 | |
| JP | 2018-522551 | A | 8/2018 | |
| KR | 20-2017-0000467 | U | 2/2017 | |
| SU | 1836039 | A3 | 8/1993 | |
| WO | WO 2014/195687 | A1 | 12/2014 | |
| WO | WO 2016/207407 | A1 | 12/2016 | |
| WO | WO 2017/066377 | A1 | 4/2017 | |
| WO | WO 2017/115185 | A1 | 7/2017 | |

OTHER PUBLICATIONS

Search Report and Written Opinion issued Jan. 21, 2019 in PCT/EP2018/079206 filed Oct. 24, 2018.

Combined Russian Office Action and Search Report issued Nov. 23, 2021 in Russian Patent Application No. 2020116768 (with English translation), 13 pages.

Office Action issued Nov. 16, 2022, in corresponding Japanese Patent Application No. 2020-520789 (with English Translation), 11 pages.

Chinese Office Action and Chinese Search Report mailed on Jan. 4, 2023 in Chinese Patent Application No. 201880063873.3 filed on Oct. 24, 2018, (with English Translation, total 20 pages).

Office Action and Search Report mailed on Jul. 28, 2023 issued in Chinese Patent Application No. 201880063873.3 filed on Oct. 24, 2018, with English Translation, total 21 pages.

* cited by examiner

AEROSOL-GENERATING DEVICE HAVING HOLDING MECHANISM

CROSS-REFERENCE TO RELATED APPLICATIONS

This application is a continuation of and claims benefit under 35 U.S.C. § 120 to U.S. application Ser. No. 16/754,208, filed Apr. 7, 2020, which is a U.S. National Stage application of PCT/EP2018/079206, filed on Oct. 24, 2018, and claims the benefit of priority under 35 U.S.C. § 119 from 17198144.2, filed on Oct. 24, 2017, respectively, the entire contents of each of which are incorporated herein by reference.

The invention relates to aerosol-generating systems, such as handheld electrically operated aerosol-generating systems. In particular the invention relates to aerosol-generating devices, configured to heat articles containing a supply of aerosol-forming substrate.

Articles in which an aerosol forming substrate, such as tobacco, is heated rather than combusted have been proposed in the art. Such articles are heated by an aerosol-generating device comprising a heater and a chamber, into which a portion of the article can be inserted. In particular, the aerosol-forming substrate portion of the article is inserted into the chamber, and heated to produce an aerosol. A mouth end portion of the article remains outside of the chamber, and a consumer can draw on this mouth end portion of the article to receive the aerosol. The chamber is typically an elongate cylinder, and substantially corresponds in size and shape to the size and shape of the aerosol-generating article with which the device is intended to be used. In order to appropriately locate the article in the chamber of the device, the device may comprise a heater in the form of a heater blade, which extends from the base of the chamber. When the article is inserted into the chamber the heater blade penetrates the article. In some devices, the heater blade may help to hold the article in place relative to the chamber. However, a heater blade may not always provide an appropriate means for holding the article in place, once it has been inserted into the chamber.

It has also been proposed in the art to heat articles by other means, such as a heater assembly which extends around the outer surface of the chamber. Such a heater assembly may be chosen if the article to be heated is relatively slim, because a heater blade may risk damaging such an article when it is inserted into the chamber.

In some devices, it may be desirable for the chamber of a device to have a width that is greater than the width of the articles to be heated in the chamber, in order to facilitate insertion of articles into the chamber and extraction of articles from the chamber. In particular, it may be necessary to facilitate extraction of an article from the chamber of devices comprising a heater assembly which extends around the outer surface of the chamber. This is because heating an article from the outer surface may weaken the structure of the article, particularly if the article has an outer wrapper formed from paper, which increases the risk of the article tearing as it is being removed from the chamber.

It would therefore desirable to provide an improved arrangement for holding an aerosol-generating article once it has been inserted into an aerosol-generating device. It would also therefore be desirable to provide an improved arrangement for releasing an aerosol-generating article from an aerosol-generating device to facilitate extraction of the article from the device.

According to a first aspect of the invention, there is provided an aerosol-generating device for heating an aerosol-generating article, the device comprises: a housing having an opening; a chamber disposed within the housing, and configured to receive at least a portion of the aerosol-generating article through the opening in the housing; a heater assembly disposed within the housing, and comprising a heating element configured to heat at least a portion of the chamber; and a holding mechanism comprising at least one holding member disposed at or proximate to the opening of the housing and configured to move between: a first position, in which the aerosol-generating article can be inserted into the chamber through the opening; and a second position, in which the holding member has reduced the size of the opening relative to the size of the opening when the member is in the first position.

By providing a device with a holding member that can be moved between such first and second positions, an article can be easily inserted into the chamber of the device (when the holding member is in the first position), and then securely held in place by the holding member after said insertion (when the holding member is in the second position).

By providing the holding member at or about the opening in the housing, the holding member can engage with a portion of the article which is less likely to be subjected to high temperatures from the heating assembly, such as a mouth end portion of the article. This means that the holding member is less likely to affect the aerosol generating process, and therefore less likely to have an impact on the aerosol that is delivered to the consumer, than if the holding member was configured to engage with an aerosol-forming portion of the article. The mouth end portion may also be more resilient than the aerosol-forming portion of the article. This means that the mouth end portion of the article is less likely to be damaged by the holding member, than if the holding member were engaging with the aerosol-forming portion of the article.

The arrangement of the first aspect of the present invention also enables the device to utilise heater arrangements other than heater blade arrangements, without substantial risk of the article moving within the chamber or falling out of the chamber, during use.

In embodiments of the present invention, the holding mechanism is separate from or not the same component as the heater assembly. That is, the object or objects which form the holding mechanism are not the same as the object or objects which form the heater assembly. In this way, the function and performance of the heater assembly can remain unaffected by whether or not the at least one holding member is disposed in its first position or second position.

Accordingly, the heater assembly and holding mechanism are arranged such that when an aerosol-generating article is received within the chamber, the heater assembly is configured to heat a first portion of the aerosol-generating article (such as an aerosol-forming portion) and the holding mechanism is configured to hold a second portion of the aerosol-generating article (such as a mouth end portion). For example, where the chamber has a longitudinal axis extending from the opening of the housing into the chamber, the heater assembly may be disposed within or around the chamber and longitudinally spaced from holding mechanism. More specifically, the holding mechanism may be disposed at or proximate the opening at a first longitudinal position, and the heater assembly may be disposed within or around the chamber at a second longitudinal position, the second longitudinal position being spaced further into the chamber than the first longitudinal position. Such an arrangement can reduce the likelihood of heating being affected by the holding mechanism. Such an arrangement can also mean that the holding mechanism is less likely to be subjected to high temperatures from the heater assembly.

The holding mechanism may be configured such that, when an aerosol-generating article is received within the chamber, the at least one holding member can engage with and hold the aerosol-generating article in a position where the article is not in physical contact with the heater assembly or portion of the chamber heated by the heater assembly. This may help to ensure that no single portion of the aerosol-generating article is overheated. Put another way, this may help to ensure that the aerosol-generating article is more evenly heated.

In some embodiments, the at least one holding member may be configured to substantially cover the portion of the opening between the outer surface of the article and the circumference of the opening defined by the housing when the at least one holding member is in the second position. For example, the holding mechanism may comprise a plurality of holding members arranged in an iris formation that substantially circumscribes an article received in the chamber when the holding members are in the second position. In these embodiments, the at least one holding member may substantially block or inhibit air from flowing out of the chamber between the external surface of the article and circumference of the opening defined by the housing when the at least one holding member is in the second position. As such, the at least one holding member may improve airflow through the article when the article is received in the device, as the holding member may reduce the proportion of air drawn through the device that does not pass through the article.

The holding member is disposed at or proximate to the opening of the housing. The opening may be defined by a gap or hole in the housing, through which an aerosol-generating article can be inserted. In some embodiments, the holding member may be disposed on the outer surface of a wall of the housing. This allows a user to know the position of the holding member at all times. In some embodiments, the holding member may underlie the inner surface of a wall of the housing. For example, the entire holding member may underlie the inner surface of the wall of the housing when the holding member is in the first position. In this case, the holding member may not be visible to a user. However, when the holding member is moved to the second position, at least a portion of the holding member may move towards the opening such that it no longer underlies the wall of the housing, but is instead exposed to the exterior of the device. In this case, the size of the opening is reduced by the amount of the holding member that is exposed.

As discussed in more detail below, the holding mechanism may comprise two or more opposing holding members at or proximate the opening, each holding member being movable relative to the chamber between the first and second positions. The opposing holding members may be arranged to provide opposing holding forces on an aerosol-generating article, when the article is received within the chamber and when the holding members are disposed in their second positions. This may help to ensure that the article can be held solely by the holding mechanism, rather than relying on a fixed portion of the housing or chamber wall to provide a requisite holding surface. This can therefore advantageously ensure that an aerosol-generating article may be placed into the device and held in a fixed position with respect to the device, without needing to come into direct physical contact with the heater assembly or a portion of the chamber which is heated by the heater assembly.

In some embodiments, the holding member may be configured to slide between the first and second positions. In some embodiments, the holding member may be configured to rotate between the first and second positions.

Preferably, the housing comprises a guide track along which the holding member can slide as the holding member moves between the first position and the second position. For example, the holding member may comprise a main body which sits above the outer surface of a wall of the housing and a protruding portion, which extends into an underlying guide track formed in said wall of the housing. The guide track can define the extent of movement that the holding member can have, relative to the housing.

The holding mechanism may comprise a pivot point. The holding member may be configured to pivot about the pivot point as the holding member moves between the first position and the second position. The pivot point may be disposed adjacent to the opening. The pivot point may define a pivot axis, which extends substantially parallel to a longitudinal axis of the chamber.

The holding mechanism may comprise an iris at the opening. The iris may be configured to open and close such that an aerosol-generating article can be inserted into the chamber through the opening when the iris is open, and then held in a fixed positioned relative to the chamber, by at least partially closing the iris around the mouth end portion of the aerosol-generating article. That is, the at least one holding member may comprise a plurality of blades in an iris arrangement, each of said blades being configured to move from a first position, in which the aerosol-generating article can be inserted into the chamber via the opening; and a second position, in which each blade has reduced the size of the opening relative to the size of the opening when the blades are in the first position. The blades of the iris may be disposed on the under-side of a wall of the housing. Preferably, the blades of the iris completely underlie the wall of the housing when they are in their first position. Put another way, preferably the blades of the iris are not exposed to the exterior of the housing when they are in their first position.

The at least one holding member may comprise a curved edge arranged to provide a holding surface when the holding member is in the second position. Preferably, the curved edge is a concave edge. By providing the holding member with such a curved or concave edge, the holding member can have a shape that complements the aerosol-generating article with which it engages. That is, aerosol-generating articles are commonly substantially cylindrical, and therefore the edge of the holding member can be shaped to complement the curved surface of the substantially cylindrical article which is inserted into the chamber. This can help to improve the engagement between the holding member and the aerosol-generating article. This can also help to better distribute any holding force that the holding member imposes on the aerosol-generating article, when the holding member is in the second position. This may advantageously minimise any potential damage that the holding member could cause to the aerosol generating article, when it is in the device.

The device may be provided with a closure lid or cap for closing the opening. This may be advantageous for protecting the chamber from ingress of contaminants or other debris, when the device is not in use.

In some embodiments, the at least one holding member is configured to move to a third position, in which the holding member completely closes the opening in the housing. This advantageously means that the holding member can be used for both: holding an article in a fixed position relative to the housing, when the article has been inserted into the device; and for protecting the chamber from ingress of contaminants or other debris, when the device is not in use.

The holding mechanism may be configured to lock the holding member in one or more of the first second and third positions. In the case of the third position, this advantageously means that the chamber cannot become unintentionally exposed.

Aerosol-generating articles are typically elongate cylinders. Preferably, the chamber is elongated and has a longitudinal axis extending from a base of the chamber to the opening.

The holding mechanism may be configured such that the movement of the at least one holding member between the first position and the second position is substantially perpendicular or transverse to the longitudinal axis of the chamber. In other words, where the holding mechanism comprises a guide track along which the holding member can slide, the guide track may extend substantially perpendicular to the longitudinal axis of the chamber. In other words, where the holding mechanism comprises a pivot point, the pivot point may extend substantially parallel to the longitudinal axis of the chamber.

The base of the chamber may be defined by a bottom wall. The base of the chamber may comprise one or more openings. Preferably, the chamber is cylindrical. The walls of the chamber may be formed of a thermally conductive material, such as metal.

The heating assembly may comprise any suitable number of heating elements. The heating assembly may comprise a single heating element. The heating assembly may comprise at least one heating element. The heating assembly may comprise two heating elements. The heating assembly may comprise a plurality of heating elements. Where the heating assembly comprises a plurality of heating elements, the heating elements may be arranged at different locations at or around the chamber for heating different portions of the chamber. Where the chamber comprises a longitudinal axis, the heating elements may be spaced along the longitudinal axis. Where the heating assembly comprises a plurality of heating elements, the device may be configured to activate or heat each heating element at different times. The device may be configured to heat each heating element sequentially in a predetermined sequence.

At least one wall of the chamber may be thermally coupled to the heater element. The heater assembly may comprise a heater element disposed around the outer surface of the at least one wall of the chamber.

The heating element may be any suitable type of heating element. The heating element may be an electric heating element. The electric heating element may be a resistive heating element. The electric heating element may be an inductive heating element. The heating element may be in the form of a pin or a blade. The heater element may be one or more electrically conductive tracks on an electrically insulating substrate. The electrically conductive tracks may be electrically connected to a power supply. The electrically insulating substrate may be formed from polyimide. The electrically insulating substrate may extend around the outer surface of the at least one wall of the chamber. The electrically insulating substrate may be rolled into a tube. Where the heater assembly comprises more than one heater element, each heating element may be the same type of heating element or the heater assembly may comprise different types of heating element.

The heater assembly may comprise a thermally insulating member disposed around the heater element. The thermally insulating member may be a dual walled tube that is disposed around the heater element. The dual walled tube may contain a vacuum between its two walls. Where the heater assembly comprises more than one heating element, the thermally insulating member may be disposed around more than one of the heating elements.

The holding mechanism may comprise a biasing member configured to urge the holding member to move towards a set position. The biasing member may comprise a spring, such as a helical spring. Preferably, the set position is the second position. In this case, when the device is not in use the biasing member may urge the holding member into the second position. When a consumer wishes to use the device, they can push the holding member towards the first position, overcoming the biasing force. For example, they may slide or rotate the holding member from the second position to the first position. This will act to increase the size of the opening through which an article can be inserted. The consumer can then insert the article through the opening, so that a portion of the article resides in the chamber. The consumer can then release the holding member from the first position. The biasing force of the basing member then causes the holding member to revert towards the second position, whereby it engages with the aerosol-generating article, to help to hold the article in place relative to the housing.

In some embodiments, the holding mechanism may comprise a locking mechanism for releasably locking the holding member in the second position. In these embodiments, the holding mechanism may comprise a biasing member configured to urge the holding member to move towards the first position, such that when the holding member is locked in the second position and the locking mechanism is released, the holding member is returned to the first position by the biasing member.

In some embodiments, the holding mechanism may comprise a locking mechanism for releasably locking the holding member in the first position.

A consumer may be able to directly move the at least one holding member between the first and second positions. For example, where the holding member comprises a main body which sits above the outer surface of a wall of the housing and a protruding portion and which extends into an underlying guide track formed in said wall of the housing, the consumer can move the holding member between the first and second positions with their fingers.

The holding mechanism may further comprise a control member on the outer surface of the housing. The control member may be coupled to the holding member such that actuation of the control member causes the holding member to move between the first and second positions. In some embodiments, the control member may be a button, which a user can press to cause the holding member to move from the first position to the second position, or from the second position to the first position, or both. In some embodiments, the control member may be an element that a user can slide to cause the holding member to move between the first and second positions. The control member may be advantageous when the holding member at least partially underlies a wall of the housing, since the control member can provide a convenient facility for the consumer to interact with in order to move the holding member.

The holding mechanism may be configured to move the holding member from the first position to the second position in response to activation of the heating assembly. For example, the holding mechanism may comprise a switch, which is electrically coupled to a temperature sensor. In such a case, the switch may be configured to initiate movement of the holding member from the first position to the second position, in response to receiving a signal from the temperature sensor indicating that a threshold temperature value has been reached. The switch may be electrically connected to a power supply, which is electrically connected to the heater assembly. In such a case, the switch may be configured to initiate movement of the holding member from the first position to the second position, in response to receiving a signal indicating that power is being supplied to the heater. In some embodiments, the heating element may be used as a temperature sensor, wherein the electrical resistance of the heating element may be measured and used as an indication of the temperature of the heating element.

The holding mechanism may be configured to detect when a portion of an aerosol-generating article is disposed at the base of the chamber. The holding mechanism may further be configured to move the holding member from the first position to the second position in response to detecting that a portion of an aerosol-generating article is disposed at the base of the chamber. For example, the holding mechanism may comprise a switch, which is electrically coupled to a laser sensor in the chamber. In such a case, the switch may be configured to initiate movement of the holding member from the first position to the second position, in response to receiving a signal from the laser sensor indicating that an object is present in the base of the chamber.

In some embodiments, the holding mechanism may further comprise a distal holding member disposed at or proximate to a distal end of the chamber, opposite the opening. The distal holding member may be configured to move between: a first position, in which the aerosol-generating article can be inserted into the chamber to at or around the distal end; and a second position, in which the holding member has reduced the size of the distal end of the chamber relative to the size of the distal end of the chamber when the distal holding member is in the first position. The holding element at or proximate the opening may be coupled to the distal holding element such that when the holding element at or proximate the opening is moved between the first and second positions, the distal holding element is also moved between the first and second positions.

In particular the holding mechanism may comprise a distal holding member where the holding mechanism comprises two or more opposing holding members at or proximate the opening. In some particular embodiments, the holding mechanism may comprise a plurality of holding elements arranged in an iris arrangement at or proximate to the opening and a plurality of distal holding elements arranged in an iris arrangement at or proximate the distal end of the chamber.

Advantageously, providing a holding mechanism with at least one distal holding element may further enable the holding mechanism to hold the article in place in the chamber when the holding elements are in the second position. Advantageously, providing a holding mechanism with at least one distal holding element may facilitate locating the article in the chamber, away from the chamber walls.

As used herein, "electrically conductive" means formed from a material having a resistivity of 1×10−4 Ohm meter, or less. As used herein, "electrically insulating" means formed from a material having a resistivity of 1×104 Ohm meter or more.

Preferably, the aerosol-generating device comprises a power supply configured to supply power to the heating element. The power supply preferably comprises a power source. Preferably, the power source is a battery, such as a lithium ion battery. As an alternative, the power source may be another form of charge storage device such as a capacitor. The power source may require recharging. For example, the power source may have sufficient capacity to allow for the continuous generation of aerosol for a period of around six minutes or for a period that is a multiple of six minutes. In another example, the power source may have sufficient capacity to allow for a predetermined number of puffs or discrete activations of the heater assembly.

The power supply may comprise control electronics. The control electronics may comprise a microcontroller. The microcontroller is preferably a programmable microcontroller. The electric circuitry may comprise further electronic components. The electric circuitry may be configured to regulate a supply of power to the heater assembly. Power may be supplied to the heater assembly continuously following activation of the system or may be supplied intermittently, such as on a puff-by-puff basis. The power may be supplied to the heater assembly in the form of pulses of electrical current.

Preferably, the aerosol-generating system is a handheld system. Preferably, the aerosol-generating system is portable.

It will be appreciated that preferred features described above in relation to one aspect of the invention may also be applicable to other aspects of the invention.

Embodiments of the invention will now be described, by way of example only, with reference to the accompanying drawings, in which.

Figure 1A:
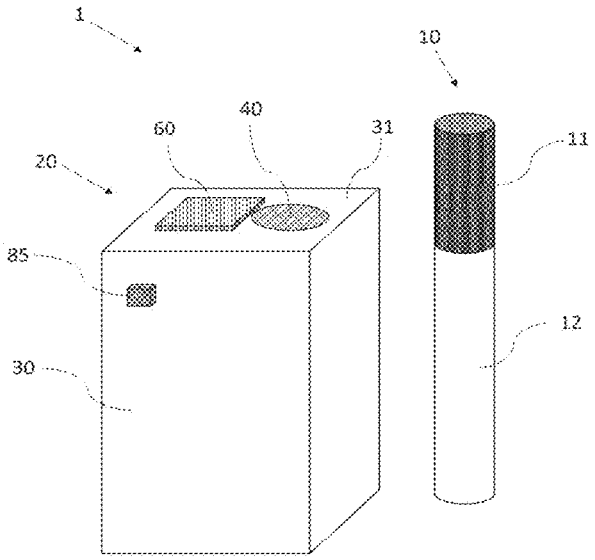
FIGS. 1A-1B show a perspective view of an aerosol-generating system comprising an aerosol-generating article and an aerosol-generating device according to a first embodiment of the present invention.
Figure 1B:
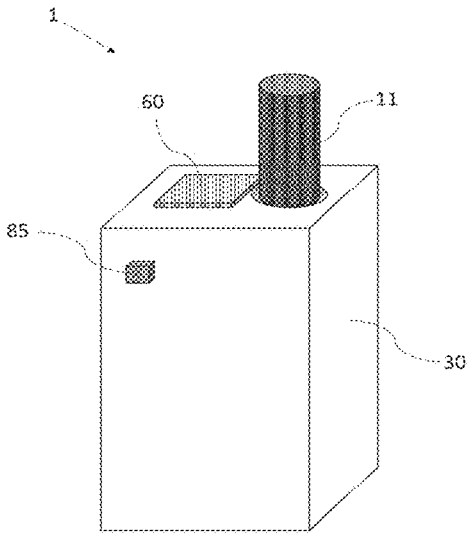

FIGS. 1A-1B show a perspective view of an aerosol-generating system 1 comprising an aerosol-generating article 10 and an aerosol-generating device 20 according to a first embodiment of the present invention. The article 10 comprises a mouth end portion 11 in the form of a mouth piece. The mouth end portion may comprise one or more mouthpiece segments, such as a hollow tube or a filter plug. The mouth end portion 11 is secured to an aerosol-forming portion 12 comprising an aerosol-forming substrate. The aerosol-forming substrate may be in the form of a paper wrapper circumscribing a rod of tobacco containing material.

The aerosol-generating article 10 is configured to be inserted into the aerosol-generating device 20. In particular, the device 20 comprises a housing 30 having an opening 40 through which the article can be inserted. As best seen from FIG. 2, the device 20 contains a cylindrical chamber 50 within the housing 30. The chamber 50 has a longitudinal axis 52 extending from a base 54 of the chamber 50 to the opening 40.

The chamber 50 is configured to receive at least the aerosol-forming portion 12 of the aerosol-forming article. In particular, as shown in FIG. 1B, the aerosol-forming article 10 can be inserted into the device 20 through the opening 40 in the housing 30, such that the aerosol-forming portion of the article 12 resides in the chamber 50, and at least part of the mouth end portion 11 of the article 10 extends outside of the device 20.

Figure 2:
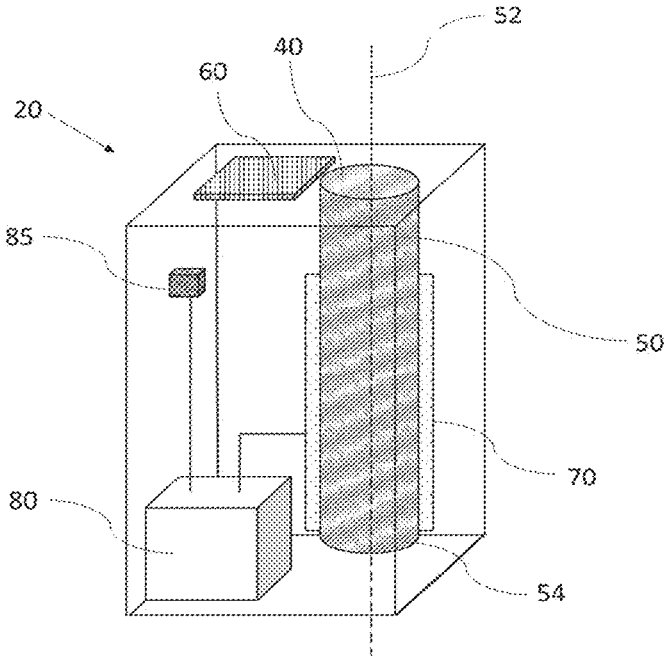
FIG. 2 shows a perspective view of the inside of the aerosol-generating device of FIG. 1.

As best seen from FIG. 2, the chamber 50 is thermally coupled to a heater assembly 70, which is disposed in the device 20. The heater assembly 70 may comprise a heater element comprising one or more electrically conductive tracks on an electrically insulating substrate. The electrically insulating substrate may circumscribe the cylindrical wall of the chamber 50.

The heater assembly 70 is electrically connected to a power supply 80, which contains a power source in the form of a battery and control electronics for operating the heater assembly 70. The power supply 80 is also electrically connected to a power control button 85, which when actuated can control the supply of power to the heater assembly 70.

As shown in FIGS. 1A-1B, the device 20 is provided with a holding mechanism comprising a holding member 60 disposed on the outer surface of the top wall 31 of the housing 30. The holding member 60 is disposed adjacent to the opening 40 and configured to move between: a first position, in which the aerosol-generating article 10 can be inserted into the chamber 50 via the opening 40; and a second position, in which the holding member 70 has reduced the size of the opening relative to the size of the opening when the member is in the first position. This is best illustrated by the embodiments shown in FIGS. 3A to 7C, which are described in more detail below. The embodiments shown in FIGS. 3A to 7C are substantially similar to embodiment shown in FIGS. 1A to 2, and like reference numerals are used to refer to like features. The embodiments shown in FIGS. 3A to 7C differ from the embodiment shown in FIGS. 1A to 2 by way of the holding mechanism at or proximate to the top wall of the device 20.

Figure 3C:
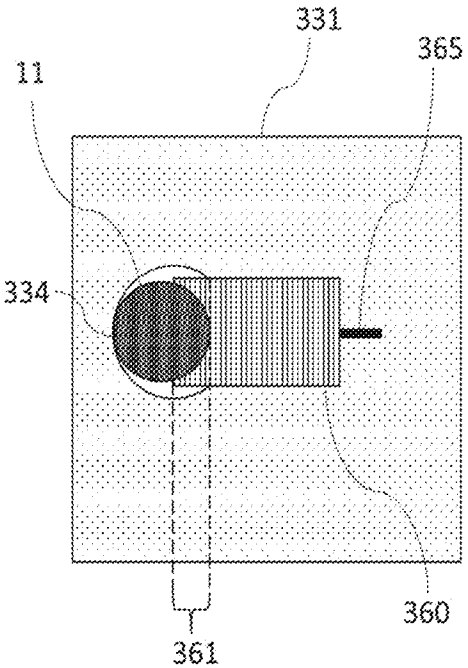
FIGS. 3A-3C show a top view of an aerosol-generating device according to a second embodiment of the present invention.
Figure 3B:
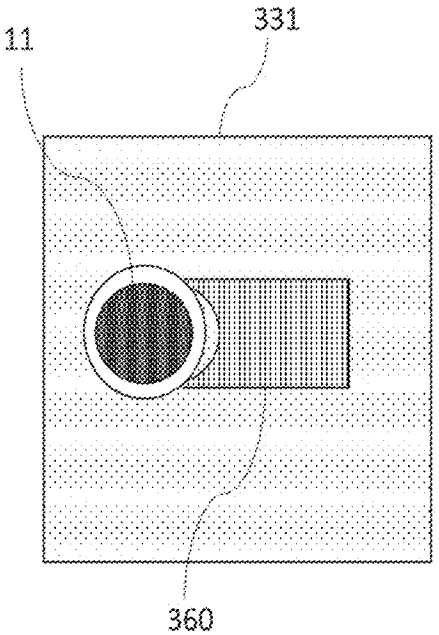
Figure 3A:
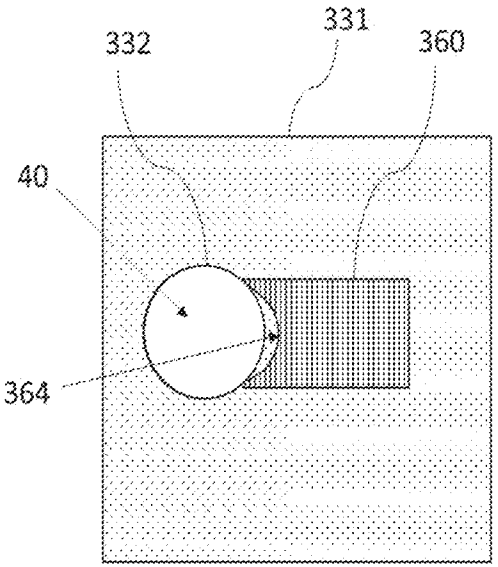

FIGS. 3A to 3C illustrate a top view of an aerosol-generating device 20 according to a second embodiment of the present invention. The views shown in FIGS. 3A to 3C are each taken along the longitudinal axis 52 of the chamber 50. As shown in FIG. 3A, a holding member 360 is disposed on the top wall 331 of the housing, adjacent to the opening 40. The holding member is shown in the first position in FIG. 3A. In this position, the opening 40 is defined solely by the perimeter 332 of a substantially circular hole formed in the top wall 331 of the housing 30. In this configuration, the perimeter 332 solely defines the cross sectional area of the opening 40 as viewed from the top view of FIG. 3A.

FIG. 3B illustrates the top view of the second embodiment, when an aerosol-generating article 10 has been inserted into the chamber of the device 20. The mouth end of the article extends out of the opening 40. As can be seen from FIG. 3B, the outer diameter of the article 10 is smaller than the diameter of the chamber 50. As such, the cross-sectional area of the opening 40 as viewed from the top view of FIG. 3B is greater than the transverse cross-sectional area of the aerosol-generating article 10. The aerosol-generating article 10 is therefore free to move within the chamber 50 of the device. In order to more securely hold the article 10 in place within the device 20, the holding member 360 is movable from the first position of FIG. 3B to the second position of FIG. 3C. Movement can be achieved by sliding the holding member 360 along a guide track 365 in the top wall 31 of the housing 30. In particular, the holding member may comprise a main body which sits above the outer surface of the top wall 31 and a protruding portion (not shown), which extends into the underlying guide track 365 formed in said wall of the housing 30. The guide track 365 can define the extent of movement that the holding member 360 can have, relative to the housing 30. In this embodiment, a user may grasp the main body of the holding member with their hand and manually slide the holding member 360 along the guide track 365 between the first and second positions.

When the holding member 360 is disposed in the second position shown in FIG. 3C, the size of the opening 40 has been reduced relative to the size of the opening 40 when the member is in the first position of FIG. 3A. This is because a portion of the holding member now overlies the hole in the top wall 31 of the housing, and thus reduces the cross-sectional area of the opening 40 as viewed from the top view of FIG. 3C. In particular, the cross-sectional area of the opening 40 is now defined by both a portion of the perimeter 332 in the top wall 331 of the housing 30, and the external edge of an engaging portion 361 of the holding member 360.

Therefore, when the holding member 360 is in the second position, a portion of the holding member 360 engages with the mouth end portion 11 of the article 10. In particular, when the holding member 360 is in the second position, the mouth end portion 11 of the article 10 is clamped between the engaging portion 361 of the holding member 360 and an engaging edge 334 of the opening 40 defined by the top wall 331 of the housing 30. These edges together act to hold the article 10 in place with respect to the device 20. The engaging portion 361 of the holding member 360 has a concave edge 364, which is shaped to complement the aerosol-generating article with which it engages.

Although not shown in FIGS. 3A to 3C, the holding member 360 may be coupled to a biasing member. The biasing member may be in the form of a helical spring. The biasing member may be configured to urge the holding member 360 to move towards the second position. In such a scenario, a user will need to first overcome the biasing force of the spring to move the holding member 360 to the first position. The user can then insert an article 10 into the device 20 and release the holding member 360. The spring will then urge the holding member 360 back towards the second position, so that it engages with the mouth end portion 11 of the article 10 to hold the article in place by clamping the mouth end portion 11 of the article 10 between the concave edge 364 of the holding member 360 and the engaging edge 334 of the opening 340. The spring can therefore advantageously ensure that there is a sufficient clamping force on the article 10 to hold it in place.

Figure 4C:
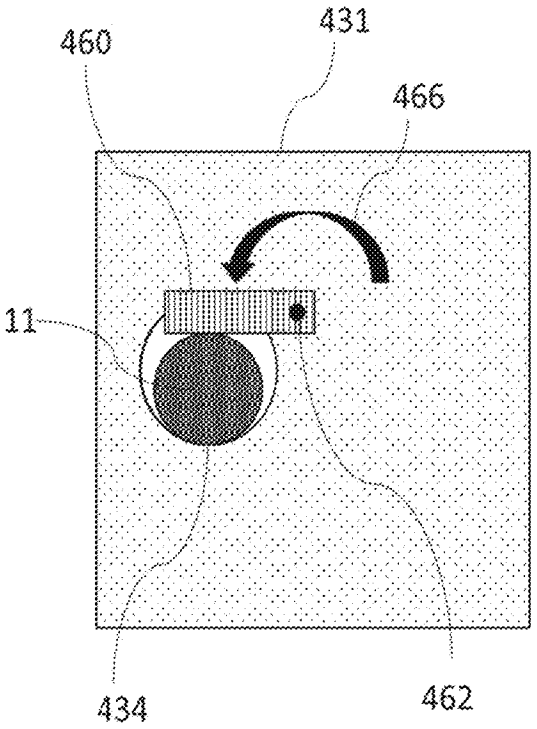
FIGS. 4A-4C show a top view of an aerosol-generating device according to a third embodiment of the present invention.
Figure 4B:
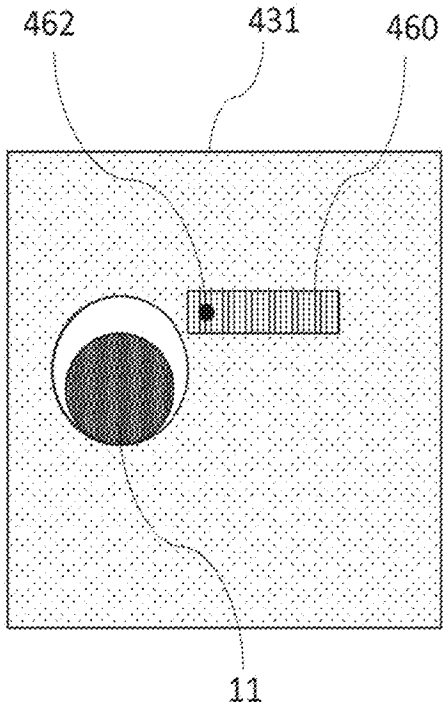
Figure 4A:
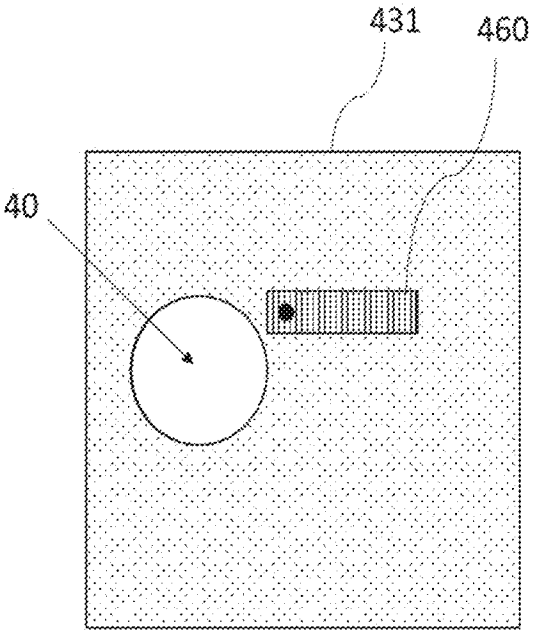

FIGS. 4A to 4C illustrate a top view of an aerosol-generating device 20 according to a third embodiment of the present invention. The arrangement of FIGS. 4A to 4C is similar to that of FIGS. 3A to 3C. However, in FIGS. 4A to 4C, the holding member 460 is now in the form of an arm, which is configured to move between the first and second positions, by way of rotation about a pivot point 462.

In FIGS. 4A and 4B, the holding member 460 is in the first position; in FIG. 4C, the holding member has pivoted about pivot point 462 to move into the second position. In the second position, the mouth end portion 11 of the article 10 is clamped between the holding member 460 and an engaging edge 434 of the opening 40 defined by the top wall 431 of the housing 30. The pivot movement is depicted by arrow 466.

Figures 5A, 5B, 5C:
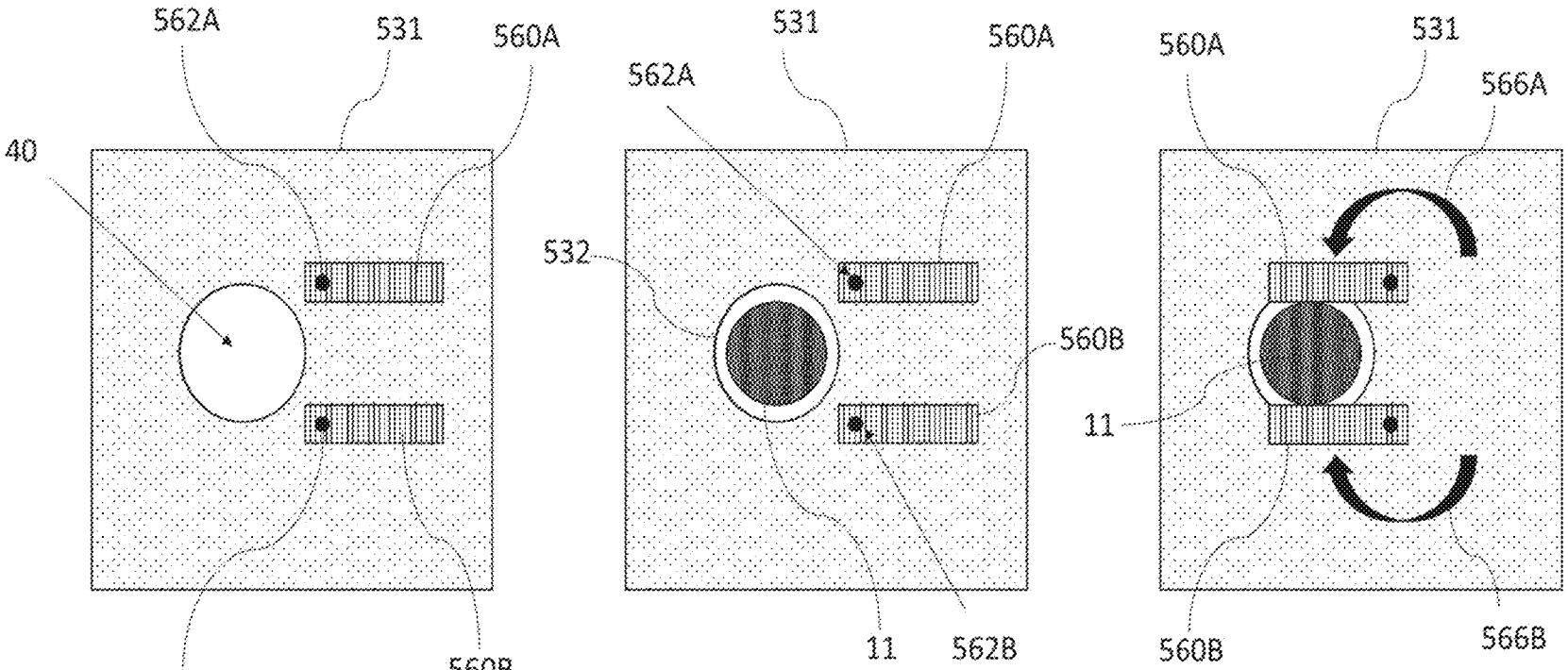
FIGS. 5A-5C show a top view of an aerosol-generating device according to a fourth embodiment of the present invention.

FIGS. 5A to 5C illustrate a top view of an aerosol-generating device 20 according to a fourth embodiment of the present invention. The arrangement of FIGS. 5A to 5C is similar to that of FIGS. 4A to 4C. However, in FIGS. 5A to 5C, the holding mechanism comprises two holding members; namely a first holding member 560A, and a second holding member 560B. Each holding member 560A, 5608 is in the form of an arm, which is configured to move between the first and second positions, by way of rotation about a respective pivot point 562A, 562B.

In FIGS. 5A and 5B, the holding members 560A, 560B are in respective first positions; in FIG. 5C, each holding member has pivoted about respective pivot point 562A, 562B to move into respective second position. The pivot movements are depicted by respective arrows 566A, 566B. The arms 560A, 560B and pivot points 562A, 562B are spaced to opposite sides of the chamber 50, by equal distances.

In this arrangement, when both holding members 560A, 560B are in respective second positions, the article 10 is held in place within the device 20, but is not in contact with the perimeter 532 of the substantially circular hole formed in the top wall 531 of the housing 30. Instead, the mouth end portion 11 of the article 10 is now clamped between respective engaging portions of the two holding members 560A, 560B. The arrangement of the fourth embodiment of the present invention can advantageously mean that the article 10 is held centrally within the chamber 40, and evenly spaced from the walls of the chamber 40. This may improve the consistency of the aerosol that is produced by articles 10 that are inserted into the device 20.

Figures 6A, 6B, 6C:
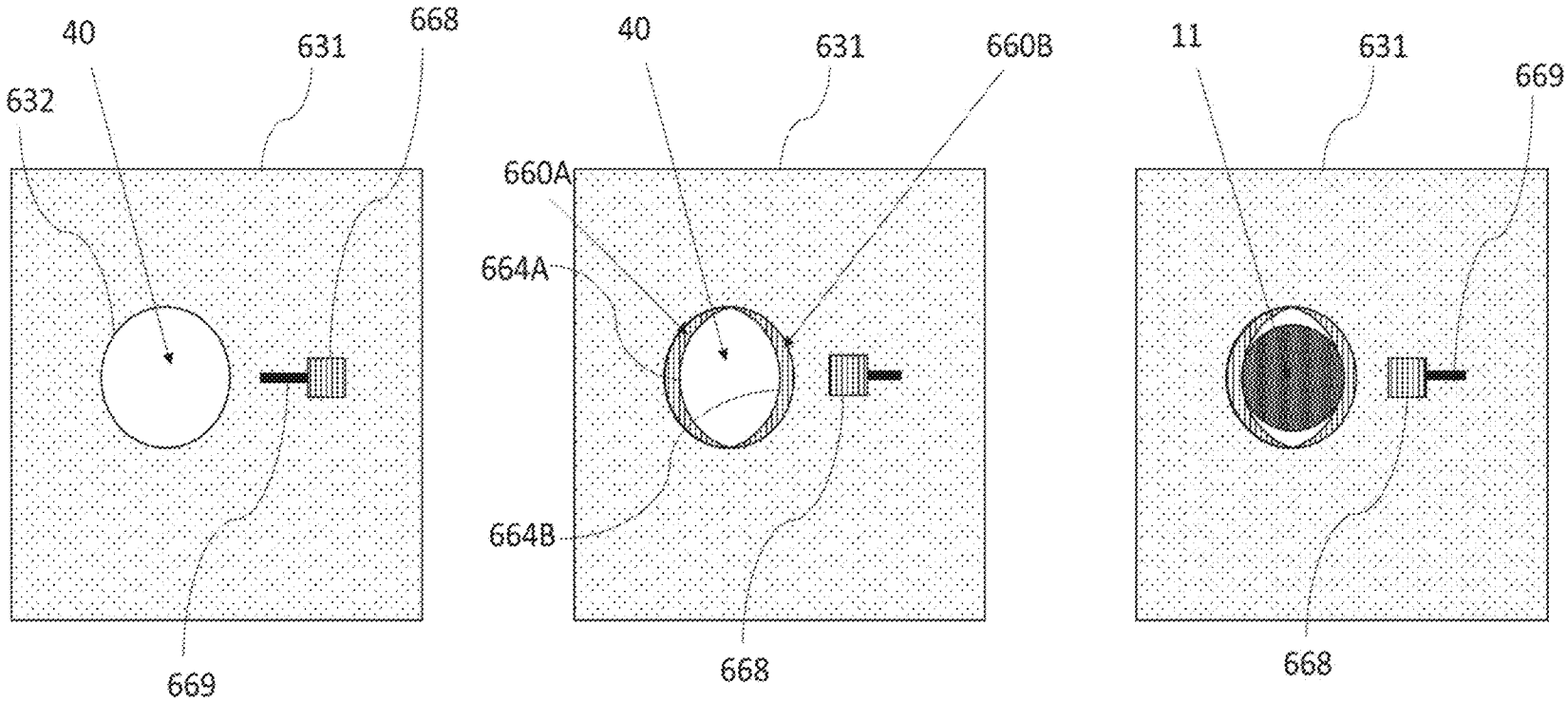
FIGS. 6A-6C show a top view of an aerosol-generating device according to a fifth embodiment of the present invention.

FIGS. 6A to 6C illustrate a top view of an aerosol-generating device 20 according to a fourth embodiment of the present invention. The fourth embodiment is similar to the first, second and third embodiments. However, in the fourth embodiment the holding mechanism comprises first and second holding members 660A, 660B which are not disposed on the outer surface of the top wall 631 of the housing 30. Instead, the first and second holding members 660A, 660B underlie the inner surface of the top wall 631 of the housing 30. FIG. 6A shows the first and second holding members when in the respective first positions. In this position, the opening 40 is defined solely by the perimeter 632 of a substantially circular hole formed in the top wall 631 of the housing 30. That is, the perimeter 632 solely defines the cross sectional area of the opening 40 as viewed from the top view of FIG. 3A.

In FIG. 6A, the first and second holding members 660A, 660B entirely underlie the inner surface of the top wall 631 of the housing 30, and therefore are not visible or accessible to a user. However, when the first and second holding members 660A, 660B are moved to the respective second positions, as shown in FIGS. 6B and 6C, at least a portion of the first and second holding members 660A, 6608 move towards the opening 40 such that they no longer fully underlie the top wall 631 of the housing 30, but instead are exposed to the exterior of the device 20. In this configuration, the size of the opening 40 is reduced by the area of the first and second holding members 660A, 6608 that is exposed. That is, the opening 40 is now defined solely by the engaging edges 664A, 664B of the first and second holding members 660A, 660B. Each engaging edge 664A, 664B is concave shaped.

The holding mechanism of the fourth embodiment further comprises a control member 668 on the outer surface of the top wall 631 of the housing 30. The control member 668 is coupled to the first and second holding members 660A, 660B such that actuation of the control member 668 causes the first and second holding members 660A, 660B to move between the first and second positions. In the embodiment of FIGS. 6A to 6C the control member 668 is an element that a user can slide to cause each of the first and second holding members 660A, 660B to move between their respective first and second positions. In particular, a user can slide the element 668 along a guide track 669 from the first position shown in FIG. 6A to the second position shown in FIGS. 6B and 6C to move each of the first and second holding members 660A, 660B from their respective first positions to their respective second positions. The element 668 advantageously provides a user with a convenient means for moving the holding members 660A, 660B. In particular, a control member is advantageous in embodiments having one or more holding members substantially or entirely underlying the top wall of the housing in the first position, such that the holding member is substantially inaccessible to a user.

The first and second holding members 660A, 660B of the fourth embodiment are substantially similar to the holding member 360 of the second embodiment, shown in FIGS. 3A to 3C, having a similar shape and being arranged to slide between the first and second positions along tracks (not shown) in the housing 30. The first and second holding members 660A, 660B are configured to slide in opposite directions on movement of the control member 668 for clamping and releasing the aerosol-generating article 10 between them. It will be appreciated that in other embodiments, the first and second holding members may be arranged to move between the first and second positions in other ways, such as by pivoting about a pivot point.

Figure 7C:
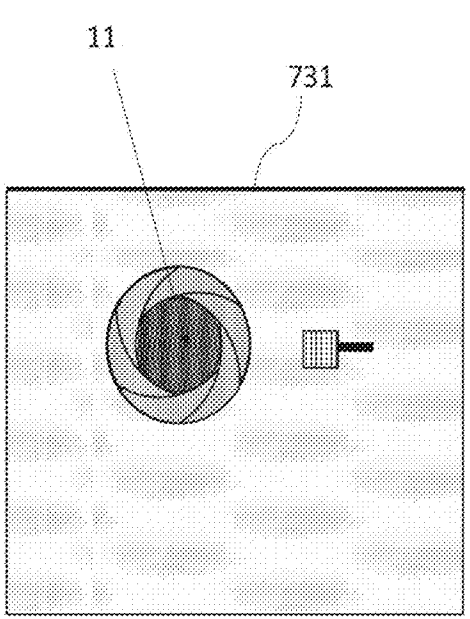
FIGS. 7A-7C show a top view of an aerosol-generating device according to a sixth embodiment of the present invention.
Figure 7B:
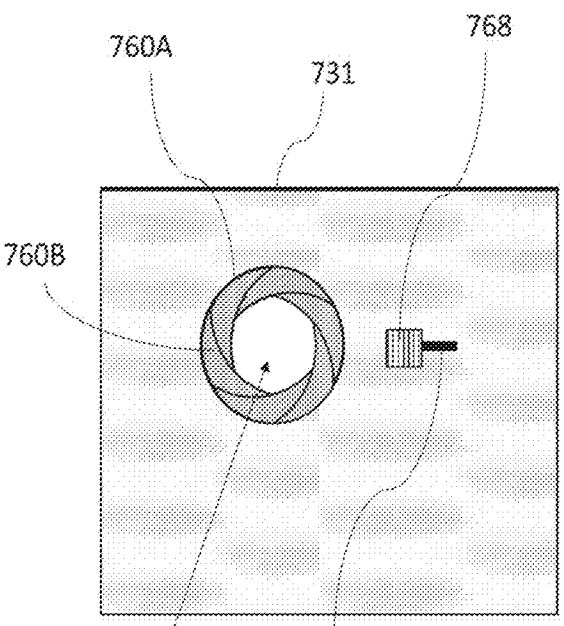
Figure 7A:
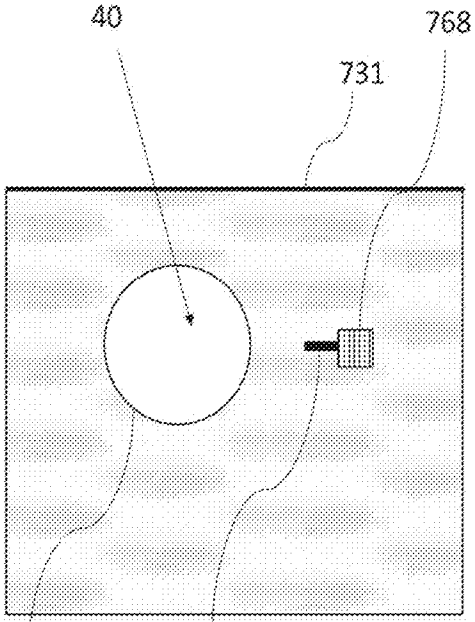

FIGS. 7A to 7C illustrate a top view of an aerosol-generating device 20 according to a fifth embodiment of the present invention. The fifth embodiment is similar to the fourth embodiment. However, in the fifth embodiment the holding mechanism comprises an iris at the opening 40 (see FIG. 7B). In particular, a plurality of holding members 760A, 760B are provided in the form of a plurality of blades in an iris arrangement. Each blade 760A, 760B is configured to move from a first position, in which the aerosol-generating article 10 can be inserted into the chamber via the opening 40; and a second position, in which the mouth end portion of the aerosol-generating article 10 can be held in place centrally in the opening 40, between the blades, each blade 760A, 760B having reduced the size of the opening 40 relative to the size of the opening 40 when the blades are in the first position. This can be best appreciated from FIGS. 7A and 7B.

In FIG. 7A, the holding member blades 760A, 760B are in the first position and completely underlie the inner surface of the top wall 731 of the housing 30. Therefore, in this configuration, the opening 40 is defined solely by the perimeter 732 of a substantially circular hole formed in the top wall 731 of the housing 30. However, when the holding member blades 760A, 760B are moved to the second position, as shown in FIGS. 7B, the size of the opening 40 is reduced by the area of the blades that is exposed. Consequently, the opening 40 is now defined solely by the engaging edges the blades of the iris arrangement. Movement of the blades can be controlled by sliding control member 768 along guide track 769, in a similar manner to that described above with respect to FIGS. 6A to 6C.

The invention claimed is:

1. An aerosol-generating device for heating an aerosol-generating article, the aerosol-generating device comprising:

a housing having an opening;

a chamber disposed within the housing, and configured to receive at least a portion of the aerosol-generating article through the opening in the housing;

a heater assembly disposed within the housing, and comprising a heating element configured to heat at least a portion of the chamber;

a mechanism comprising at least one member disposed at or proximate to the opening of the housing and configured to move between:

a first position, in which the aerosol-generating article can be inserted into the chamber via the opening, and a second position, in which the at least one member has reduced a size of the opening relative to a size of the opening when the at least one member is in the first position; and at least one guide track along which the at least one member is configured to slide when the at least one member moves between the first position and the second position.

2. The aerosol-generating device according to claim 1, wherein the at least one member underlies an inner surface of a wall of the housing.

3. The aerosol-generating device according to claim 1, wherein the mechanism is separate from the heater assembly.

4. The aerosol-generating device according to claim 1, wherein the mechanism is not a same component as the heater assembly.

5. The aerosol-generating device according to claim 1, wherein the chamber has a longitudinal axis extending from the opening of the housing into the chamber.

6. The aerosol-generating device according to claim 5, wherein the at least one guide track extends substantially perpendicular to the longitudinal axis of the chamber.

7. The aerosol-generating device according to claim 5, wherein movement of the at least one member between the first position and the second position is substantially perpendicular to the longitudinal axis of the chamber.

8. The aerosol-generating device according to claim 5, wherein the heater assembly is disposed within or around the chamber and longitudinally spaced from the mechanism.

9. The aerosol-generating device according to claim 5, wherein the mechanism is disposed at or proximate the opening at a first longitudinal position, and the heater assembly is disposed within or around the chamber at a second longitudinal position.

10. The aerosol-generating device according to claim 1, further comprising a control member coupled to the at least one member of the mechanism such that actuation of the control member causes the at least one member of the mechanism to move between the first position and the second position.

11. The aerosol-generating device according to claim 10, wherein the control member is an element that is slidable by a user to cause the at least one member to move between the first position and the second position.

12. The aerosol-generating device according to claim 10, wherein the at least one member is configured to move from the first position to the second position in a first direction, and wherein the control member is configured to move in a second direction to cause the at least one member to move from the first position to the second position, the second direction being different from the first direction.

13. The aerosol-generating device according to claim 1, wherein the at least one member comprises a plurality of blades, each of the blades being configured to move from a first position, in which the aerosol-generating article can be inserted into the chamber via the opening, and a second position, in which each blade has reduced the size of the opening relative to the size of the opening when the blades are in the first position.

14. The aerosol-generating device according to claim 1, wherein the at least one member is further configured to move to a third position, in which the at least one member completely closes the opening in the housing.

15. The aerosol-generating device according to claim 1, wherein at least one wall of the chamber is thermally coupled to the heater element.

16. The aerosol-generating device according to claim 15, wherein the heater assembly further comprises a heater element disposed around an outer surface of the at least one wall of the chamber.

17. The aerosol-generating device according to claim 1, wherein the mechanism further comprises a biasing member configured to urge the at least one member to move towards a set position.

18. The aerosol-generating device according to claim 17, wherein the set position is the first position.

19. The aerosol-generating device according to claim 17, wherein the set position is the second position.

20. An aerosol-generating system comprising an aerosol-generating device according to claim 1, and an aerosol-generating article configured to be inserted into the chamber of the aerosol-generating device.

* * * * *